US005848448A

United States Patent [19]

Boyd

[11] Patent Number: 5,848,448

[45] Date of Patent: Dec. 15, 1998

[54] PILLOW WITH CUTOUTS ADAPTED TO ACCOMMODATE THE EAR, NOSE AND CHEEK OF A USER

[75] Inventor: Ardis M. Boyd, New York, N.Y.

[73] Assignee: UltraDerma, Ltd., New York, N.Y.

[21] Appl. No.: 828,174

[22] Filed: Mar. 18, 1997

[51] Int. Cl.[6] ..... A61G 9/00

[52] U.S. Cl. ..... 5/636; 5/638; 5/490

[58] Field of Search ..... 5/636, 638, 637, 5/640, 643, 644, 645, 490; D6/601

[56] References Cited

U.S. PATENT DOCUMENTS

| | | | |
|---|---|---|---|
| D. 298,198 | 10/1988 | O'Sullivan | D6/601 |
| 2,295,906 | 9/1942 | Lacour | 5/636 |
| 3,124,812 | 3/1964 | Milton et al. | 5/638 |
| 3,141,179 | 7/1964 | McLean | 5/638 |
| 3,366,106 | 1/1968 | Yao et al. | 5/638 |
| 4,118,813 | 10/1978 | Armstrong | 5/638 |
| 4,788,728 | 12/1988 | Lake | 5/636 |
| 4,908,893 | 3/1990 | Smit | 5/636 |
| 5,515,545 | 5/1996 | Becton | 5/490 |

*Primary Examiner*—Alexander Grosz
*Attorney, Agent, or Firm*—Stevens, Davis, Miller & Mosher, L.L.P.

[57] ABSTRACT

A pillow that does not promote facial wrinkling or earaches including a solid foam body. The body is sculptured to have hollows or cutouts positioned and specifically shaped on its longitudinal axis for receiving the facial tissue of a user so as to prevent wrinkles to the facial tissue.

13 Claims, 2 Drawing Sheets

PILLOW WITH CUTOUTS ADAPTED TO ACCOMMODATE THE EAR, NOSE AND CHEEK OF A USER

FIELD OF THE INVENTION

This invention relates to a pillow and more particularly to a pillow having hollows which allows one using the pillow to sleep in a prone or side position without fear of inducing wrinkles to facial tissues.

BACKGROUND OF THE INVENTION

The standard pillow for sleeping has been in use for many years. Unfortunately, standard pillows exert pressure on a users face when the user is lying in a prone position and the user's head is positioned sideways on the pillow or the user is sleeping in a side position. This pressure is generally uneven and can result in creasing of facial tissue, especially in areas of high pressure. As the user grows older and sleeping patterns are continually repeated these creases become increasingly persistent. Over a period of time the daily pressure on the face for a period of several hours may encourage the formation of permanent wrinkles and thus accelerate aging of the face. In addition, conventional pillows do not support the neck and head of a user and, therefore, can lead to relative discomfort during sleep or rest and neck pains or backaches following sleep or periods of rest. Still another drawback of conventional pillows is that they can cause earaches because they exert pressure on the ear of a user whose head lies in a side position.

U.S. Pat. No. 4,788,728, granted Dec. 6, 1988 (herein incorporated by reference) discloses a contoured pillow with a central aperture. It is reported that the pillow prevents pressure on a users face. U.S. Pat. No. 4,908,893, granted Mar. 20, 1990 (herein incorporated by reference) discloses numerous pillow embodiments which do not promote facial wrinkles. Unfortunately, these two references fail to provide pillows having shapes specifically designed to approximate certain facial tissue, including the nose, cheek and ear of a user while providing proper support.

Accordingly, it is an object of the invention to provide a pillow with areas approximating the dimensions of certain facial tissue and for receiving facial tissue prone to creasing. The pillow also provides support for the user.

SUMMARY OF THE INVENTION

This invention relates to a pillow that does not promote facial wrinkling or earaches and includes a foam body. The body is sculptured to have hollows or cutouts specifically shaped and positioned on its longitudinal axis for receiving the facial tissue of a user so as to prevent wrinkles to the facial tissue.

DETAILED DESCRIPTION OF THE INVENTION

Figure 1:
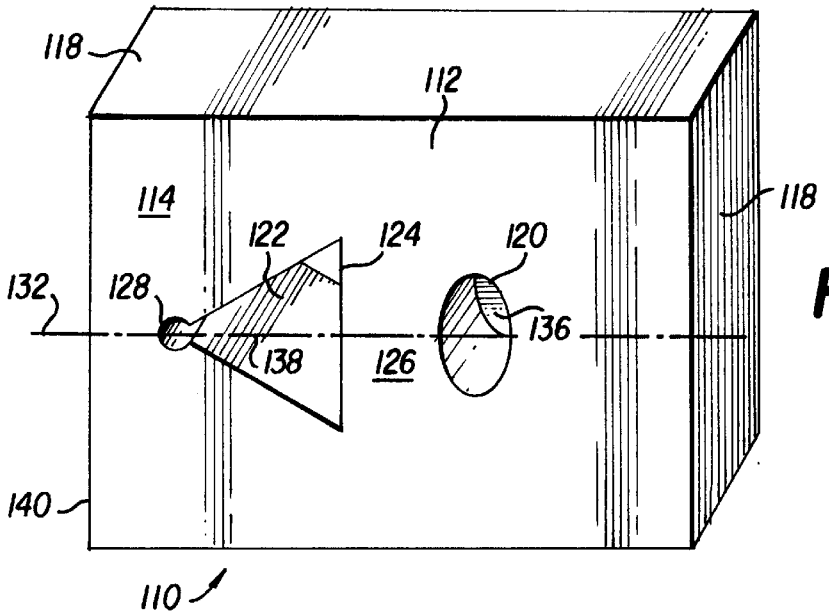
FIG. 1 is a plan view of a pillow of the invention for use in travel.

FIG. 1 shows a first embodiment of the pillow 110 of the invention. Pillow 110 is of a size for travel (its conveniently portable) and may be made from a variety of materials that have sufficient firmness to provide proper support for the head and neck of a user and to provide dimensional stability to the pillow. Examples of suitable materials for constructing pillow 110 is a high quality latex foam rubber or polyurethane foam or any type of foam of sufficient stability, such as that used in cushions and pillows in household furniture. Ideally, the foam has any conventional density. Pillow 110 may also be constructed of halves or sections sewn together and filled with foam pieces or other materials allowing for the pillow to be compressed but repeatedly returnable to substantially its original shape when the compression force is removed.

Pillow 110 has body 112 defined by a top 114, a bottom 116 (FIG. 2), and side surfaces 118. Body 112 includes two hollow members 120 and 122 which are spaced apart by divider 126 and positioned on the longitudinal axis 132 of the pillow. Hollow 120 is shaped to comfortably receive an ear. Hollow 122 is shaped to receive the nose or a substantial portion thereof and a cheek of a user when the ear is positioned in hollow 120. Of course the portion of the nose received by hollow 122 will depend on the position of the users head. As seen in FIG. 1, hollow 120 is of an oval configuration and preferably extends from top 114 through body 112 to bottom 116 of pillow 110. Hollow 122 is substantially triangular in shape and includes an enlarged, substantially circular apex 128 for providing additional room for air exchange for easier breathing. Hollow 122 also preferably extends from top 114 through body 112 to bottom 116. In this manner the two faces of the pillow 114 and 116 are substantially similar and, ideally, indistinguishable. Of course, this construction allows the user to use either face of the pillow in a like manner.

In a preferred embodiment, the portable pillow 110 is approximately 11 inches long, 11 inches wide and about 4 inches high. Hollow 120 has a minor axis of 2.25 inches and a major axis of 2.5 inches. Divider 126 is an inch wide; and the length of a perpendicular line 138 as measured from base 124 of hollow 122 to its apex (i.e., its height) is 4.25 inches; its base is 5.5 inches long. As discussed above, the hollows are located on the longitudinal axis of the pillow such that the minor axis 136 of hollow 120 and the line (138) bisecting hollow 122 are co-linear with the longitudinal axis 132 of pillow 110. Apex 128 of hollow 122 is located approximately 1.25 inches from the side edge 140 of pillow 110. Hollow 120 measured from its axial center is approximately three and ⅞ inches from the right side of body 112 as shown and is three and ⅝ inches from a top or bottom edge of the pillow. The distance between the ear hole and the bottom edge provides neck support to a user of the pillow. These dimensions allow for the portability of the pillow. That is, pillow 110 can be conveniently carried into a hotel or onto plane, train, boat, etc. and used in association with the sleeping arrangements of such facilities.

Figure 2:
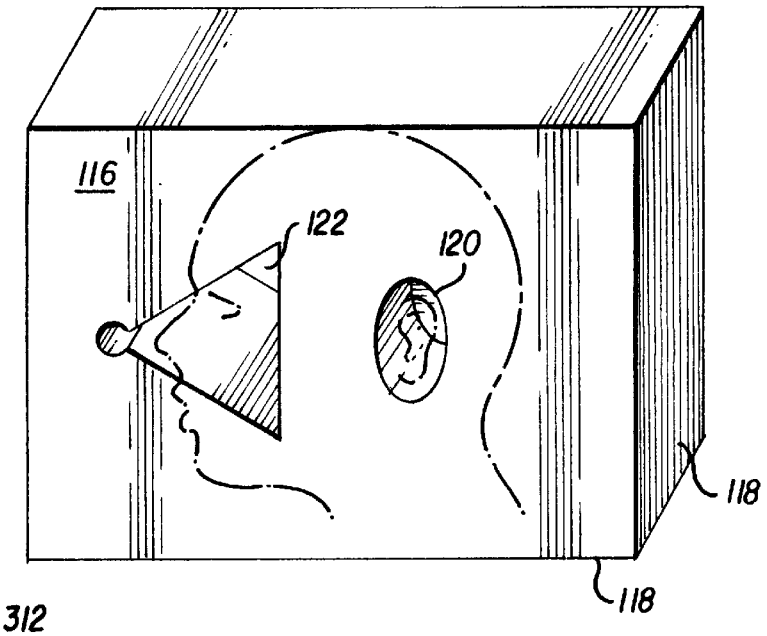
FIG. 2 is a bottom view showing a head correctly positioned on the pillow of FIG. 1.

A use of the pillow is shown in FIG. 2. In a preferred embodiment, pillow 110 of the invention is positioned on top of a softer pillow (not shown), such as a conventional down-filled or low density foam pillow. Pillow 110 is positioned so that the bottom of pillow 110 is flush with the bottom of the softer pillow and the user's shoulder is resting on, for instance, a mattress and not on either pillow.

Figure 3:
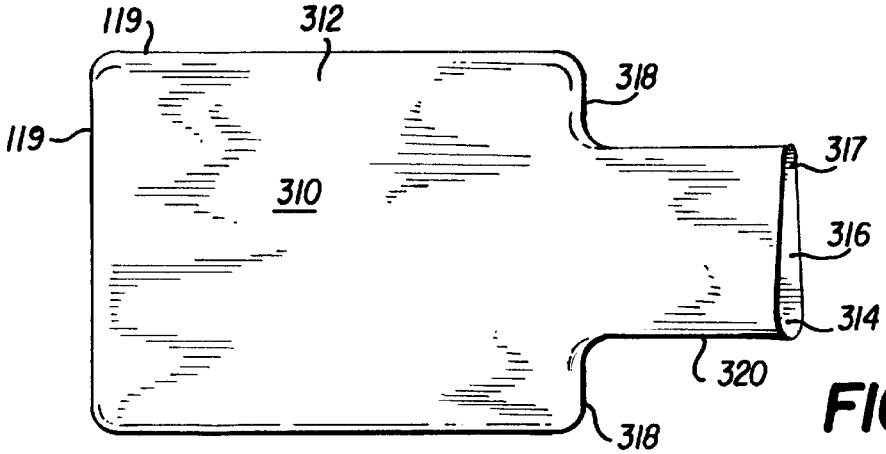
FIG. 3 is a plan view of the pillow case used in association with the pillow of FIG. 1.

For purposes of hygiene, hair care, and aesthetics, pillow 110 is preferably provided with a pillowcase 310 shown in FIG. 3. Pillowcase 310 has a top layer 312 and a bottom layer 314 which are stitched together along three peripheral edges to leave a side opening 316 in a manner similar to that of a conventional pillowcase. However, pillowcase 310 differs from a conventional pillowcase in having shoulder members 318 forming an extended sleeve 320 defining a reduced lip 117, which is much smaller relative to sides 119. This construction imparts a bottleneck appearance to the pillow. Shoulder members 318 and the stitched edges of the pillowcase 310 define a compartment of dimensions larger than the length, width and height of pillow 110. These dimensions allow a user to stuff surplus pillowcase material into the hollows so as to prevent the pressure that causes wrinkles. This is, of course, in keeping with the design and function of the pillow. The reduced side opening 316 serves to retain pillow 110 within pillowcase 310. Pillow case 310 is preferably manufactured from a satiny material, but can of course be made from cotton, polyester, silk, etc.

Figure 4:
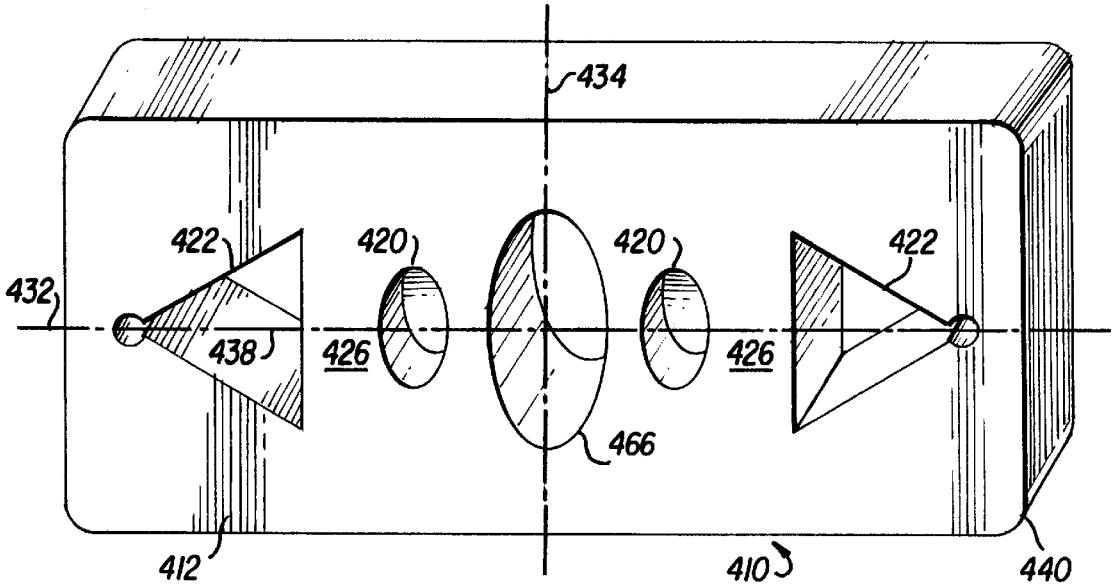
FIG. 4 is a plan view of a deluxe pillow (standard, queen, or king) for use in association with a twin or double bed.
Figure 5:
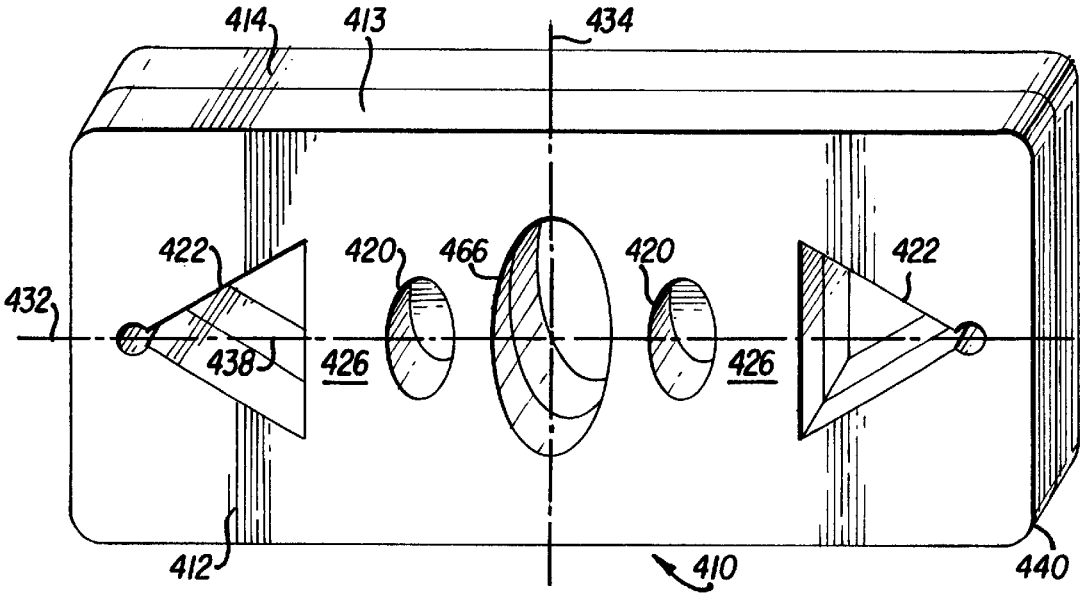
FIG. 5 is a laminate version of the pillow of FIG. 4.

FIG. 4 shows a second embodiment of the invention, a deluxe pillow 410, for use on a standard, queen, or king bed and may be sized to so fit such a bed. This pillow is preferably made of the same foamed rubber latex or urethane material as is pillow 110. It may be made as a solid foam piece from which cutouts are made. These cutouts may extend completely through body 412 as in pillow 110 or only one-half way through body 412. Alternatively, as shown in FIG. 5, the pillow can be constructed of a two-piece laminate where a top section 413 has hollows 420 and 422 extending through its body, and section 413 is laminated to a solid bottom section 414. Section 414, in this instance, functions as the conventional pillow and may be of foam material that is less dense or softer than the foam of section 413. For instance, section 114 may have a density and the section 113 may have a greater density. Optionally, pillow 410 could be constructed from a two-piece laminate made up of sections 413 and 414 and hollows 420 through 422 extend through the bodies of both sections. In this way, both faces of pillow 410 are identical and the two faces accommodate the sleeper when facing the right or left side.

Pillow 410 includes a longitudinal axis 432 and a vertical axis 434. As shown in FIG. 4, two similarly shaped oval hollows 420 are positioned on either side of vertical axis 434 and two similarly shaped triangular hollows 422 are positioned at opposite ends of pillow 410. Hollows 420 and 422 are of dimensions substantially equal to the dimensions of hollows 120 and 122 respectively. As discussed above, it is preferable that the hollows extend only one-half of the way through the body 412 of pillow 410, but may extend through the totality of the body 412.

Measured from center to center, hollows 420 are spaced apart by about a distance of 8.25 inches and the length of solid foam material between hollows 420 is approximately 6 inches. Similar to the device shown in FIG.1, hollows 420 have a minor axis of 2.25 inches and a major axis of 2.5 inches. Dividers 426 separating hollows 420 from 422 are each an inch wide; and the length of a perpendicular line 438 as measured from the base of each hollow 422 to their respective apexes is 4.25 inches; the base of each triangular hollow 422 is 5.5 inches long. Again similar to the pillow of FIG. 1, the four hollows of FIG. 4 are all located on the longitudinal axis 432 of pillow body 412 such that the minor axes of hollows 420 and lines 438 bisecting hollows 422 are co-linear with the longitudinal axis 432. Pillow 410 is approximately 24 inches long, 13 inches wide, and 4–6 inches high or more. If the pillow is constructed of foam pieces laminated together, it is preferable that the two pieces are of similar dimensions.

In this embodiment, all corners 440 of the pillow are rounded to facilitate placement of the pillow into a pillow case and to prevent eye injuries in the event the pillow is used without a pillowcase. In the event a pillowcase is not used, it is preferred, for purposes of comfort, that the pillow be provided with smooth exterior surfaces. It is preferable to use a pillowcase with all the disclosed embodiments. Conventional standard, queen, and king pillowcases can be used with pillow 410, as the dimensions of pillow 410 will serve to retain it in such a pillowcase.

The pillows of the embodiments shown and described are first manufactured as a solid piece of foam as is known in the art. The foam is cut to size and then either manually, or preferably mechanically sculptured, to create hollows, to round corners and /or to further sculpt the pillows, and then laminated if desired. In general, the surfaces of the pillows are planar, but it may be advantageous to alter a planar surface. For instance, the pillows in the embodiment shown in FIG. 4 are optionally sculpted to create a shallow well or crevice 446 in the area between hollows 420, i.e., about the point of intersection of the two axes. Well 446 may be about 5.8 to 7 inches in length as measured on the vertical axis 434 and about 4–6 inches in length as measured on the horizontal axis 432. In this manner a person resting in the supine position can position his head within well 446 and with little or no effort assume a side position such that the ear, cheek and nose of the person become positioned in hollows 420 and 422.

The figures and description of the several embodiments above, are solely for purposes of illustration and are not intended to limit the invention in any way. The invention is limited to the claims appended hereto as well as equivalents thereof.

What is claimed is:

1. A substantially rectangular pillow comprising a compressible body having similar top and bottom faces and at least a first and a second hollow extending through the body of the pillow; said first hollow for receiving the ear of the a person; said second hollow for receiving the nose of a person and a cheek of the person, said hollows being of different shapes.

2. The pillow of claim 1 wherein said second hollow is substantially triangular in shape.

3. A combination pillow and pillow case, said pillow comprising compressible body having similar top and bottom faces and at least a first and a second hollow extending through the body of the pillow, said first hollow for receiving the ear of a person; said second hollow for receiving the nose of the person and a cheek of the person, said pillow enclosed within a woven pillowcase, and said hollows being of different shares.

4. The combination of claim 3 wherein said pillowcase is open at one end.

5. The combination of claim 3 wherein the pillowcase has an opening and the opening is smaller in width than any side of the pillow.

6. A substantially rectangular pillow comprising a compressible body, a longitudinal axis and a plurality of cutouts of at least two different shapes for receiving facial appendages, said cutouts disposed on and spaced apart along said longitudinal axis.

7. The pillow of claim 6 wherein at least one of said cutouts is a hollow member extending from one surface of said body to an opposite surface of said body and said at least one cutout is substantially triangular in shape.

8. A pillow adapted to support a human head comprising a compressible body, said body having a vertical and a longitudinal axis, and a first and a second pair of shaped cutouts, spaced relative to each other such that a first cutout can receive the ear the of a person and the second cutout can simultaneously receive the nose and cheek of a person, said first pair of shaped cutouts being substantially similarly shaped, adjacent one another, and positioned on said longitudinal axis and said second pair of cutouts, separated by, and of a shape different from said first two substantially similarly shaped cutouts and also positioned on said longitudinal axis.

9. The pillow of claim 8 wherein said first substantially similarly shaped cutouts are positioned on either side of said vertical axis.

10. The pillow of claim 9 further comprising a shallow well positioned between said first substantially similar shaped cutouts for positioning the head of a person resting in a supine position.

11. The pillow of claim 8 wherein said first substantially similarly shaped cutouts are shaped to receive an ear.

12. The pillow of claim 10 wherein said second similarly shaped cutouts are shaped to receive a nose and a cheek of a person.

13. The pillow of claim 8 wherein said body comprises a first and second piece laminate and said similarly shaped cutouts are hollow members extending from one surface of at least one of said pieces of laminate to an opposite surface thereof.

* * * * *